US006682829B2

(12) United States Patent
Toyooka et al.

(10) Patent No.: US 6,682,829 B2
(45) Date of Patent: Jan. 27, 2004

(54) WELDED STEEL PIPE HAVING EXCELLENT HYDROFORMABILITY AND METHOD FOR MAKING THE SAME

(75) Inventors: Takaaki Toyooka, Handa (JP); Masatoshi Aratani, Handa (JP); Yoshikazu Kawabata, Handa (JP); Yuji Hashimoto, Chiba (JP); Akira Yorifuji, Handa (JP); Takatoshi Okabe, Handa (JP); Takuya Nagahama, Handa (JP); Mitsuo Kimura, Handa (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 10/160,820

(22) Filed: May 31, 2002

(65) Prior Publication Data

US 2003/0044638 A1 Mar. 6, 2003

(30) Foreign Application Priority Data

May 31, 2001 (JP) ..... 2001-164189
May 31, 2001 (JP) ..... 2001-164736

(51) Int. Cl.[7] ..... B32B 15/18; C21D 8/10

(52) U.S. Cl. ..... 428/683; 138/171; 148/516; 148/519; 148/529; 148/590

(58) Field of Search ..... 428/683; 148/516, 148/519, 529, 590; 138/171

(56) References Cited

U.S. PATENT DOCUMENTS 6,006,789 A * 12/1999 Toyooka et al. ..... 138/171

FOREIGN PATENT DOCUMENTS

| | | |
|---|---|---|
| EP | 0 924 312 A | 6/1999 |
| EP | 0 940 476 A | 9/1999 |
| JP | 11 172376 A | 6/1999 |

* cited by examiner

*Primary Examiner*—Robert R. Koehler
(74) *Attorney, Agent, or Firm*—Piper Rudnick LLP

(57) ABSTRACT

A welded steel pipe is formed by heating or soaking an untreated welded steel pipe having a steel composition comprising, on the basis of mass percent: about 0.05% to about 0.3% C; about 2.0% or less of Si; more than about 1.5% to about 5.0% Mn; about 0.1% or less of P; about 0.01% or less of S; about 0.1% or less of Cr; about 0.1% or less of Al; about 0.1% or less of Nb; about 0.3% or less of Ti; and about 0.01% or less of N; and by diameter-reduction-rolling the treated steel pipe at a accumulated diameter reduction rate of at least about 35% and a finish rolling temperature of about 500° C. to about 900° C. The welded steel pipe exhibits excellent hydroformability, i.e., has a tensile strength of about 780 MPa or more and a n×r product of at least about 0.15. The treated steel pipe is preferably diameter-reduction-rolled at a accumulated diameter reduction rate of at least about 20% below the $Ar_3$ transformation point.

13 Claims, 2 Drawing Sheets

WELDED STEEL PIPE HAVING EXCELLENT HYDROFORMABILITY AND METHOD FOR MAKING THE SAME

BACKGROUND OF THE INVENTION

1. Field of the Invention

The present invention relates to welded steel pipes suitable for forming structural components and underbody components of vehicles. In particular, the present invention relates to enhancement of hydroformability of welded steel pipes.

2. Description of the Related Art

Hollow structural components having various cross-sectional shapes are used in vehicles. Such hollow structural components are typically produced by spot welding parts formed by press working of a steel sheet. Since hollow structural components of current vehicles must have high shock absorbability for collision impact, the steels used as raw materials must have higher mechanical strength. Unfortunately, such high-strength steels exhibit poor press formability. Thus, it is difficult to produce structural components having highly precise shapes and sizes without defects from the high-strength steels by usual press forming.

A method that attempts to solve such a problem is hydroforming in which the interior of a steel pipe is filled with a high-pressure liquid to deform the steel pipe into a component having a desired shape. In this method, the cross-sectional size of the steel pipe is changed by a bulging process. A component having a complicated shape can be integrally formed and the formed component exhibits high mechanical strength and rigidity. Thus, the hydroforming attracts attention as an advanced forming process.

In the hydroforming process, electrically welded pipes composed of low or middle carbon steel sheets containing 0.10 to 0.20 mass percent carbon are often used due to high strength and law cost. Unfortunately, the electrically welded pipes composed of low or middle carbon steel sheets have poor hydroformability; hence, the pipes cannot be sufficiently expanded.

A countermeasure to enhance the hydroformability of the electrically welded pipes is use of ultra-low carbon steel sheet containing an extremely reduced amount of carbon. The electrically welded pipes composed of the ultra-low carbon steel sheet exhibit enhanced hydroformability. However, the seam of the pipe causes softening with grain growth by heat of seam welding during a pipe forming process, so that the seam is intensively deformed in a bulging process, thereby impairing the high ductility of the raw material. Thus, it is desired that welded pipes have enhanced mechanical properties and excellent seam properties durable for hydroforming.

SUMMARY OF THE INVENTION

An object of the present invention is to provide a welded steel pipe having excellent hydroformability durable for a severe hydroforming process.

Another object of the present invention is to provide a method for making the welded steel pipe.

In the present invention, the welded steel pipe has a tensile strength TS of about 780 MPa or more and a n×r product of the n-value and the r-value of about 0.15 or more. In a more preferred embodiment, the welded steel pipe has a tensile strength TS of in the range of about 780 MPa to about 980 MPa, and a n×r product of about 0.22 or more. In the preferred embodiment, preferably the n-value is at least 0.15 or the r-value is at least 1.5. In another more preferred embodiment, the welded steel pipe has a tensile strength TS of more than about 980 MPa, and a n×r product of about 0.15 or more. In this embodiment, preferably the n-value is at least 0.10 or the r-value is at least 1.0.

The inventors have intensively investigated compositions of welded steel pipes and methods for making the welded steel pipes in order to solve the above problems, and have discovered that a welded steel pipe that contained about 0.05 to about 0.3 mass percent carbon and a variable amount of Mn depending on the target properties and that was diameter-reduction-rolled at a accumulated diameter reduction rate of about 35% or more and a finish rolling temperature of about 500° C. to about 900° C. has a high n×r product (product of an n-value and an r-value) and exhibits excellent hydroformability.

The inventors have completed the present invention after additional investigation in view of the above results.

According to a first aspect of the present invention, a welded steel pipe having excellent hydroformability has a composition comprising, on the basis of mass percent, about 0.05% to about 0.3% C; about 0.01% to about 2.0% Si; more than about 1.5% to about 5.0% Mn; about 0.01% to about 0.1% P; about 0.01% or less of S; about 0.01% to about 0.1% Cr; about 0.01% to about 0.1% Al; about 0.01% to about 0.1% Nb; about 0.01% to about 0.3% Ti; about 0.001% to about 0.01% N; and the balance being Fe and incidental impurities, wherein the tensile strength of the welded steel pipe is about 780 MPa or more, and the n×r product of the n-value and the r-value is about 0.15 or more.

Preferably, the composition comprises, on the basis of mass percent, about 0.05% to about 0.3% C; about 0.01% to about 2.0% Si; more than about 1.5% to about 2.0% Mn; about 0.01% about 0.1% P; about 0.01% or less of S; about 0.01% to about 0.1% Cr; about 0.01% to about 0.1% Al; about 0.01% to about 0.1% Nb; about 0.1% to about 0.3% Ti; about 0.001% to about 0.01% N; and the balance being Fe and incidental impurities, wherein the tensile strength of the welded steel pipe is in the range of about 780 MPa to about 980 MPa, and the n×r product of the n-value and the r-value is about 0.22 or more.

Preferably, the n-value is about 0.15 or more or the r-value is about 1.5 or more.

Preferably, the composition further comprises at least one element group selected from the group consisting of group A and Group B, on the basis of mass percent, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth metal.

Alternatively, the composition preferably comprises, on the basis of mass percent, about 0.05% to about 0.3% C; about 0.01% to about 2.0% Si; more than about 2.0% to about 5.0% Mn; about 0.01% to about 0.1% P; about 0.01% or less of S; about 0.01% to about 0.1% Cr; about 0.01% to about 0.1% Al; about 0.01% to about 0.1% Nb; about 0.01% to about 0.1% Ti; about 0.001% to about 0.01% N; and the balance being Fe and incidental impurities, wherein the tensile strength of the welded steel pipe exceeds about 980 MPa, and the n×r product of the n-value and the r-value is about 0.15 or more.

In such a composition, preferably, the n-value is about 0.10 or more or the r-value is about 1.0 or more.

Preferably, such a composition further comprises at least one element group selected from the group consisting of Group A and Group B, on the basis of mass percent, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth metal.

According to a second aspect of the present invention, a method for producing a welded steel pipe having excellent hydroformability comprises: heating or soaking an untreated welded steel pipe having a steel composition containing, on the basis of mass percent: about 0.05% to about 0.3% C, about 2.0% or less of Si, more than about 1.5% to about 5.0% Mn, about 0.1% or less of P, about 0.01% or less of S, about 0.1% or less of Cr, about 0.1% or less of Al, about 0.1% or less of Nb, about 0.3% or less of Ti, and about 0.01% or less of N; and diameter reduction-rolling the treated steel pipe at a accumulated diameter reduction rate of about 35% or more and a finish rolling temperature of about 500° C. to about 900° C., the welded steel pipe thereby having a tensile strength of about 780 MPa or more and a n×r product of an n-value and an r-value of about 0.15 or more.

In this method, preferably, the treated steel pipe is diameter reduction-rolled at a accumulated diameter reduction rate of about 20% or more at a temperature below the $Ar_3$ transformation point.

In this method, preferably, the composition comprises, on the basis of mass percent, about 0.05% to about 0.3% C; about 2.0% or less of Si; more than about 1.5% to about 2.0% Mn; about 0.1% or less of P; about 0.01% or less of S; about 0.1% or less of Cr; about 0.1% or less of Al; about 0.1% or less of Nb; about 0.1% to about 0.3% Ti; and about 0.01% or less of N, wherein the tensile strength of the welded steel pipe is in the range of about 780 MPa to about 980 MPa, and the n×r product of the n-value and the r-value is about 0.22 or more.

Preferably, in the method, the composition further comprises at least one element group selected from the group consisting of Group A and Group B, on the basis of mass percent, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth metal.

In the method, alternatively, the composition preferably comprises, on the basis of mass percent, about 0.05% to about 0.3% C; about 2.0% or less of Si; more than about 2.0% to about 5.0% Mn; about 0.1% or less of P; about 0.01% or less of S; about 0.1% or less of Cr; about 0.1% or less of Al; about 0.1% or less of Nb; about 0.1% or less of Ti; and about 0.01% or less of N, wherein the tensile strength of the welded steel pipe exceeds about 980 MPa, and the n×r product of the n-value and the r-value is about 0.15 or more.

Preferably, such a composition further comprises at least one element group selected from the group consisting of Group A and Group B, on the basis of mass percent, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth metal.

The welded steel pipe according to the present invention has enhanced formability and particularly excellent hydroformability and high strength and is suitable for use in structural components. This welded steel pipe can be produced by the method according to the present invention at low costs with high productivity.

DESCRIPTION OF THE PREFERRED EMBODIMENTS

Figure 1:
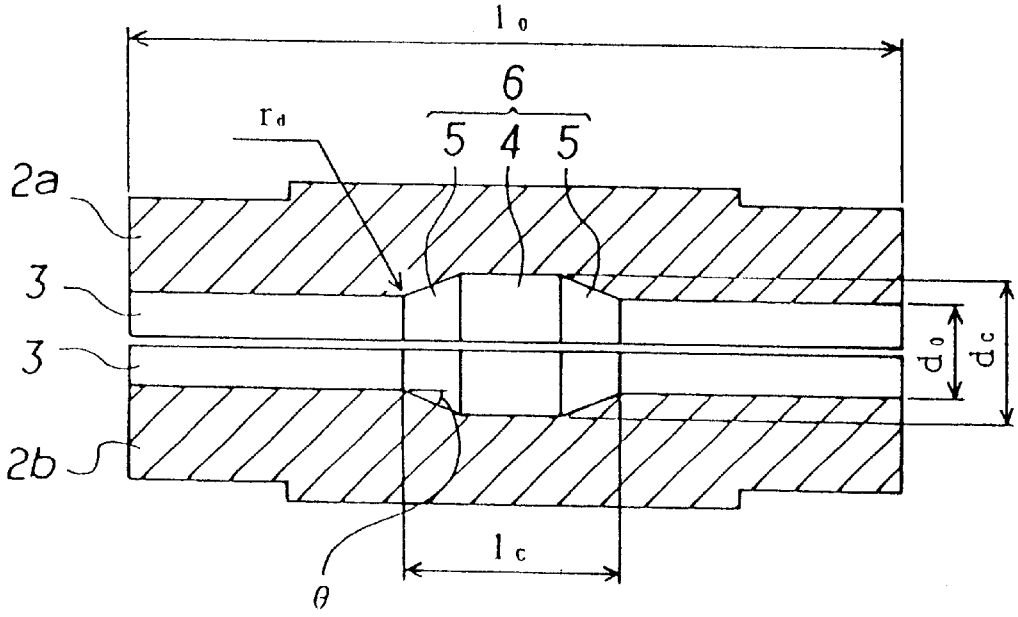
FIG. 1 is a cross-sectional view of a mold used in a free bulging test.

The reasons for the limitations in the composition of the welded steel pipe according to the present invention will now be described. Hereinafter, mass percent is merely referred to as "%" in the composition.

C: about 0.05% to about 0.3%

Carbon (C) is an element which contributes to an increase in mechanical strength of the steel. At a content exceeding about 0.3%, however, the pipe exhibits poor formability. At a content of less than about 0.05%, the pipe does not have the desired tensile strength and crystal grains become larger during a welding process, thereby resulting in decreased mechanical strength and irregular deformation. Accordingly, the C content is in the range of about 0.05% to about 0.3%, preferably in the range of about 0.05% to about 0.20% to enhance formability at a tensile strength of 980 MPa or less.

Si: about 0.01% to about 2.0%

Silicon (Si) is an element which increases the mechanical strength of the steel. In the present invention, the Si content is preferably about 0.01% or more to obtain such the effects. However, an Si content exceeding about 2.0% causes noticeable deterioration of the surface properties, ductility and hydroformability of pipe. Thus, a required limiting bulging ratio (LBR) as a measurement of the hydroformability of the pipe is not obtained. Accordingly, the Si content is about 2.0% or less and preferably in the range of about 0.05% to about 1.6% in the present invention. In order to obtain a higher tensile strength exceeding about 980 MPa, the Si content is preferably in the range of about 0.1% to about 1.5% and more preferably about 1.0% or less.

Mn: more than about 1.5% to about 5.0%

Manganese (Mn) is an element which increases mechanical the strength of the steel without deterioration of the surface properties and weldability. In the present invention, the Mn content is more than about 1.5% to obtain the desired strength. However, at an Mn content exceeding 5.0%, a desirable r-value is not obtained by the diameter reduction rolling according to the present invention, resulting in a decrease in limiting bulging ratio (LBR) during hydroforming, namely, deterioration of hydroformability. Accordingly, the Mn content in the present invention is in the range of more than about 1.5% to about 5.0%.

If the Mn content exceeds about 2.0% when a tensile strength of 980 MPa or less is required, a desirable r-value is not obtained by the diameter reduction rolling according to the present invention, resulting in a decrease in limiting bulging ratio (LBR) during hydroforming. Thus, in such a case, the Mn content is preferably in the range of more than about 1.5% to about 2.0%.

When a higher tensile strength exceeding about 980 MPa is required, the Mn content is preferably in the range of more than about 2.0% to about 5.0% and more preferably in the range of about 2.5% to about 3.5%.

P: about 0.01% 0.1%

Phosphorus (P) is an element which contributes to increase strength of steel. Such the effect of P is obtained at an amount of about 0.01% or more. However, a P content exceeding about 0.1% causes remarkable deterioration of weldability. Thus, the P content in the present invention is about 0.1% or less. When strenghtening by P is not so necessary or when high weldability is required, the P content is preferably about 0.05% or less.

S: about 0.01% or less

Sulfur (S) is present in the form of nonmetal inclusions in the steel. The nonmetal inclusions would act as nuclei for bursting of the steel pipe during hydroforming in some cases, thereby resulting in deterioration of hydroformability. Thus, it is preferable that the S content be reduced as much as possible. At an S content of about 0.01% or less, the effect of S in the deterioration of hydroformability is lowered. Thus, the upper limit of the S content in the present invention is about 0.01%. The S content is preferably about 0.003% or less and more preferably about 0.0010% or less in view of further enhancement of the hydroformability.

Al: about 0.01% to about 0.1%

Aluminum (Al) is an element which functions as a deoxidizing agent and inhibits coarsening of crystal grains. In order to reliably obtain the aforementioned effect, the Al content is preferably about 0.01% or more. However, at an Al content exceeding about 0.1%, large amounts of oxide inclusions are present, decreasing the cleanness of the steel. Accordingly, the Al content is about 0.1% or less in the present invention. The Al content is preferably 0.05% or less to reduce nuclei of bursting of the steel pipe during hydroforming.

N: about 0.001% to about 0.01%

Nitrogen (N) reacts with Al and contributes to the refinement of crystal grains. In order to reliably obtain such effect, the N content is preferably about 0.001% or more. However, an N content exceeding about 0.01% causes deterioration of ductility. Thus, the N content is about 0.01% or less in the present invention.

Cr: about 0.01% to about 0.1%

Chromium (Cr) is an element which increases strength of steel and enhances corrosion resistance of steel. These effects are noticeable at an Cr content of 0.01% or more, so the Cr content is preferably about 0.01% or more. However, a Cr content exceeding about 0.1% causes deterioration of ductility and weldability. Accordingly, the Cr content in the present invention is about 0.1% or less.

Nb: about 0.01% to about 0.1%

Niobium (Nb) is an element which contributes to the grain-refinement and increasing strength of steel by small amount addition. These effects are noticeable at an Nb content of about 0.01% or more. However, an Nb content exceeding about 0.1% causes increased hot deformation resistance of the steel, resulting in deterioration of processability and ductility. Thus, the Nb content is about 0.1% or less in the present invention.

Ti: about 0.01% to about 0.3%

Titanium (Ti) is an element which also contributes to the grain-refinement and increasing strength of steel. In the present invention, the Ti content is preferable about 0.01% or more. To obtain the desired strength of pipes, in the present invention, the Ti content is preferable about 0.01% or more. However, a Ti content exceeding about 0.3% causes increased mechanical strength, resulting in deterioration of hydroformability. Thus, the Ti content is about 0.3% or less in the present invention. When a welded steel pipe having a tensile strength of about 980 MPa or less is required, the Ti content is preferably about 0.1% or more. Also, in this case, a Ti content exceeding about 0.3% causes increased mechanical strength; hence, a desired r-value is not obtained. Accordingly, the Ti content is in the range of about 0.1% to about 0.3% for a welded steel pipe having a tensile strength of about 980 MPa or less.

If the Ti content exceeds about 0.1% in a welded steel pipe having a tensile strength exceeding about 980 MPa, the hydroformability is deteriorated due to increasing the strength. Thus, the Ti content is preferably about 0.1% or less in such a case.

In the present invention, the composition may further comprise at least one element group selected from the group consisting of Group A and Group B, on the basis of mass percent, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth metal.

Reasons for Limitations of Contents of Group A Elements

Cupper (Cu), nickel (Ni), molybdenum (Mo), and boron (B) increase strength of steel while maintaining ductility. These elements may be contained, if necessary. For increased strength, Cu, Ni, or Mo should be contained in an amount of about 0.01% or more or B should be contained in an amount of about 0.001% or more. However, the effects of these elements are saturated at a Cu, Ni, or Mo content exceeding about 1.0% or a B content exceeding about 0.01%. Furthermore, a steel containing excess amounts of these elements exhibits poor hot workability and poor cold workability. Thus, the maximum contents of these elements are preferably about 1.0% for Cu, 1.0% for Ni, about 1.0% for Mo, and about 0.01% for B.

Reasons for Limitations of Contents of Group B Elements

Calcium (Ca) and rare earth metals facilitate the formation of spherical nonmetalic inclusions, which contribute to excellent hydroformability. These elements may be contained, if necessary. Excellent hydroformability is noticeable when about 0.0020% or more of Ca or rare earth metal is contained. However, at a content exceeding about 0.02%, excess amounts of inclusions are formed, resulting in decreased cleanness of the steel. Thus, the maximum content for Ca and rare earth metals is preferably about 0.02%. When both Ca and a rare earth metal are used in combination, the total amount is preferably about 0.03% or less.

The balance of the composition is iron (Fe) and incidental impurities.

The welded steel pipe having the above composition according to the present invention has a tensile strength TS of about 780 MPa or more and a n×r product of about 0.15 or more. This values show that this welded steel pipe exhibits excellent hydroformability.

The welded steel pipe according to the present invention preferably has a tensile strength TS in the range of about 780 MPa to about 980 MPa and a n×r product of about 0.22 or more. This values show that this welded steel pipe exhibits further excellent hydroformability. If a n×r product is less than about 0.22 for this level of the tensile strength, the welded steel pipe has poor hydroformability. For this level of the tensile strength, the n-value is preferably about 0.15 or more for achieving uniform deformation and preventing pipe bursting. Furthermore, for this level of the tensile strength, the r-value is preferably about 1.5 or more for suppressing strain in the thickness direction and bursting during deformation.

In a preferred embodiment of the present invention, the welded steel pipe has a high tensile strength exceeding about 980 MPa and a n×r product of about 0.15 or more and thus exhibits enhanced hydroformability. For this level of the tensile strength, the welded steel pipe does not exhibit satisfactory hydroformability at a n×r product of less than about 0.15. For this level of the tensile strength, the n-value is preferably at least about 0.10 to prevent local deformation and bursting. For this level of the tensile strength, the r-value is preferably at least about 1.0 to suppress bursting.

Furthermore, in the welded steel pipe according to the present invention, the TS×LBR product of the tensile strength TS and the limiting bulging ratio LBR is preferably at least about 15,600 MPa·% for a tensile strength TS in the range of about 780 MPa to about 980 MPa and at least about 14,700 MPa·% for a tensile strength TS exceeding about 980 MPa. A welded steel pipe having a low tensile strength exhibits low energy absorbing capacity at collision while a small limiting bulging ratio LBR limits the shape of the product formed by hydroforming. The balance between the tensile strength TS and the limiting bulging ratio LBR is important for pipes requiring enhanced hydroformability.

The LBR is defined by the equation:

$$LBR(\%)=(d_{max}-d_0)/d_0\times 100$$

wherein $d_{max}$ is the maximum outer diameter (mm) of the pipe at burst (break) and $d_0$ is the outer diameter of the pipe before the test. The maximum outer diameter $d_{max}$ at burst is determined by dividing the perimeter of the bursting portion by the circular constant π. In the present invention, the LBR is measured by a free bulging test with axial compression.

Figure 2:
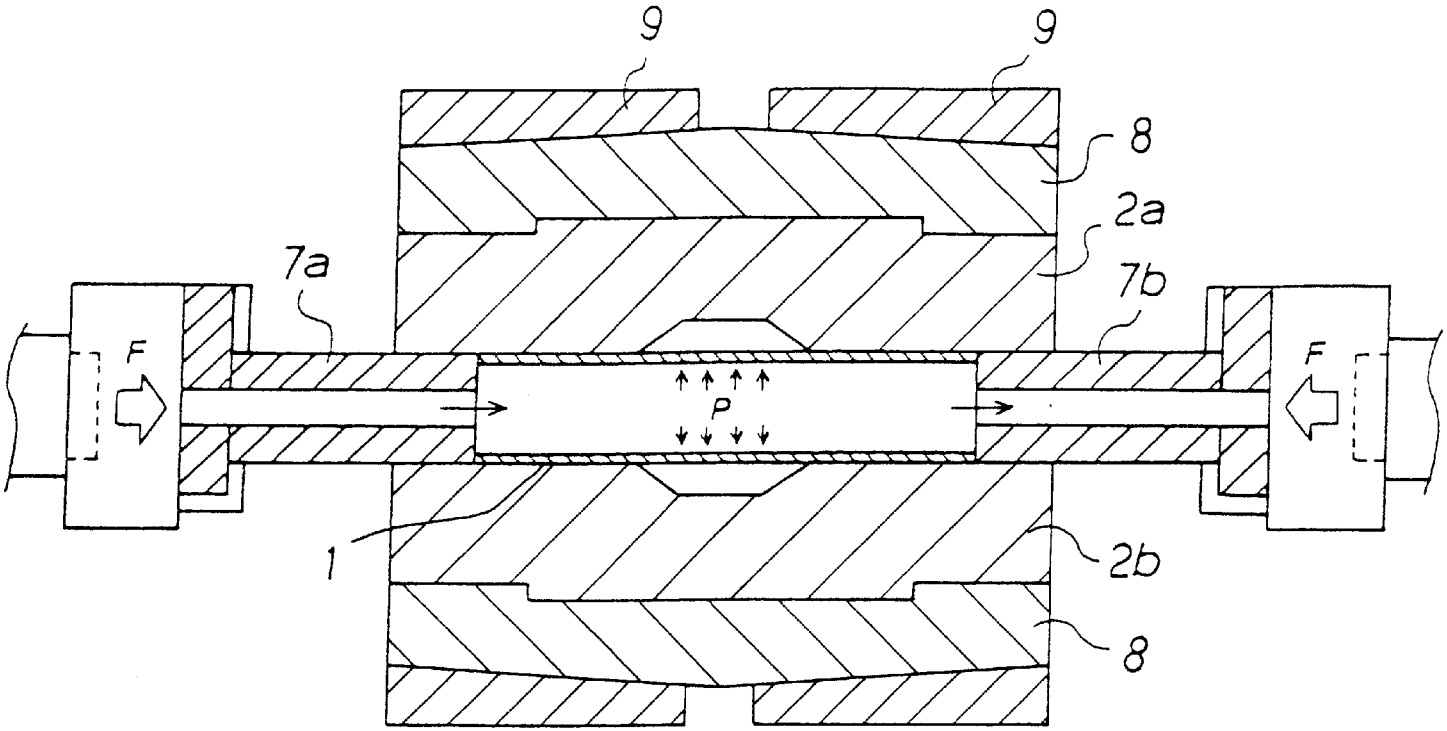
FIG. 2 is a cross-sectional view of a hydroforming apparatus used in the free bulging test.

The free bulging test may be performed by bulging the pipe, for example, in a hydroforming apparatus shown in FIG. 2 that uses a two-component mold shown in FIG. 1.

FIG. 1 is a cross-sectional view of the two-component mold. An upper mold component 2*a* and a lower mold component 2*b* each have a pipe holder 3 along the longitudinal direction of the pipe. Each pipe holder 3 has a hemispherical wall having a diameter that is substantially the same as the outer diameter $d_0$ of the pipe. Furthermore, each mold component has a central bulging portion 4 and taper portions 5 at both ends of the bulging portion 4. The bulging portion 4 has a hemispherical wall having a diameter dc, and each taper portion has a taper angle θ of 45°. The bulging portion 4 and the taper portions 5 constitute a deformation portion 6. The length $l_c$ of the deformation portion 6 is two times the outer diameter $d_0$ of the steel pipe. The diameter $d_c$ of the hemispherical bulging portion 4 may be about two times the outer diameter $d_0$ of the steel pipe.

Referring to FIG. 2, a test steel pipe 1 is fixed with the upper mold component 2*a* and the lower mold component 2*b* so that the steel pipe 1 is surrounded by the pipe holders 3. A liquid such as water is supplied to the interior of the steel pipe 1 from an end of the steel pipe 1 through an axial push cylinder 7*a* to apply the liquid pressure P to the pipe wall until the pipe bursts by free bulging in a circular cross-section. The maximum outer diameter $d_{max}$ at burst is measured.

The upper and lower mold components have respective mold holders 8 and are fixed with outer rings 9 to fix the steel pipe in the mold.

In the hydroforming process, the pipe may be fixed at both ends or a compressive force (axial compression) may be loaded from the both ends of the pipe.

In general, a higher limiting bulging ratio LBR is achieved by the axial compression. In the present invention, an appropriate compressive force is loaded from both ends of the pipe to achieve a high LBR. Referring to FIG. 2, the compressive force F in the axial direction is loaded to the axial push cylinders 7*a* and 7*b*.

A method for producing the welded steel pipe according to the present invention will now be described.

In the present invention, the welded steel pipe having the above-mentioned compositions is used as an untreated steel pipe. The method for producing the untreated steel pipe is not limited in the present invention. For example, electric resistance welding, or solid-phase pressure welding, or butt-welding is a valuable to the producing method of untreated steal pipe in the present invention. For example, strap steel is cold-, warm-, or hot-rolled or is bent to form open pipes. Both edges of each open pipe are heated to a temperature above the melting point by induction heating and butt-jointed with squeeze rolls (electric resistance welding). Alternatively, both edges of each open pipe are heated to a solid-phase pressure welding temperature below the melting point by induction heating and butt-jointed with squeeze rolls (solid-phase pressure welding). The strap steels preferably used in the present invention may be a hot-rolled steel sheet, which is formed by hot rolling a slab produced by a continuous casting process or an ingot-making/blooming process using a molten steel having the above composition, and a cold-rolled steel sheet, which is formed by cold-rolling the hot-rolled steel sheet and annealing.

In the method for producing the welded steel pipe according to the present invention, the untreated steel pipe is heated or soaked. The heating condition is not limited and preferably in the range of about 700 to about 1,100° C. to optimize the diameter reduction rolling conditions, as described below. When the temperature of the untreated steel pipe produced by warm- or hot-rolling is still sufficiently high at the reduction rolling process, only a soaking process is required to make the temperature distribution in the pipe uniform. When the temperature of the untreated steel pipe is low, heating is necessary.

The heated or soaked steel pipe is subjected to diameter reduction rolling at a accumulated diameter reduction rate of about 35% or more. The accumulated diameter reduction rate is the sum of reduction rates for individual caliber rolling stands. At a accumulated diameter reduction rate of less than about 35%, the n-value and the r-value contributing to enhanced workability and hydroformability are not increased. Thus, the accumulated reduction rate must be about 35% or more in the present invention. The upper limit of the accumulated diameter reduction rate is preferably about 95% in order to prevent increases of local wall thinning rate and ensure high productivity. More preferably, the accumulated diameter reduction rate is in the range of about 35% to about 90%. When a higher r-value is required, the diameter reduction rolling is performed at a high diameter reduction rate in the ferrite zone to develop a rolling texture. Thus, the accumulated diameter reduction rate at a temperature region below the $Ar_3$ transformation point is preferably at least about 20%.

In the diameter reduction rolling, the finish rolling temperature is in the range of about 500° C. to about 900° C. If the finish rolling temperature is less than about 500° C. or more than about 900° C., the n-value and the r-value contributing to formability are not increased or the limiting bulging ratio LBR at the free bulging test is not increased, resulting in deterioration of hydroformability. Accordingly, the finish rolling temperature is limited to about 500° C. to about 900° C. in the present invention. After the diameter reduction rolling, the pipe is preferably subjected to air cooling or accelerated cooling.

In the diameter reduction rolling, tandem rolling mill having a series of caliber rolling stands, called a reducer, is preferably used.

In the present invention, the untreated steel pipe having the above-mentioned diameter composition is subjected to the above-mentioned reduction rolling process. As a result, the rolled steel pipe as a final product has a desired tensile strength TS and a high n×r product, indicating significantly excellent hydroformability.

EXAMPLES

Example 1

Each of steel sheets (hot-rolled steel sheets and cold-rolled annealed steel sheets) having compositions shown in Table 1 was rolled to form open pipes. The open pipes were but-jointed by induction heating to form a welded steel pipe having an outer diameter of 146 mm and a wall thickness of 2.6 mm. Each welded steel pipe as an untreated steel pipe was subjected to diameter reduction rolling under conditions shown in Table 2 to form a rolled steel pipe (final product).

Tensile test pieces (JIS No. 12A test pieces) in the longitudinal direction were prepared from the rolled steel pipe to measure the tensile properties (yield strength, tensile strength, and elongation), the n-value, and the r-value. The n-value was determined by the ratio of the difference in the true stress (σ) to the difference in the true strain (e) between 5% elongation and 10% elongation according to the equation:

$$n=(\ln \sigma_{10\%}-\ln \sigma_{5\%})/(\ln e_{10\%}-\ln e_{5\%})$$

The r-value was defined as the ratio of the true strain in the width direction to the true strain in the thickness direction of the pipe in the tensile test:

$$r=\ln(W_i/W_f)/\ln(T_i/T_f)$$

wherein $W_i$ is the initial width, $W_f$ is the final width, $T_i$ is the initial thickness, and $T_f$ is the final thickness.

Since the thickness measurement included considerable errors, the r-value was determined under an assumption that the volume of the test piece was constant using the following equation:

$$r=\ln(W_i/W_f)/\ln(L_fW_f/L_iW_i)$$

wherein $L_i$ is the initial length and $L_f$ is the final length.

In the present invention, strain gages were bonded to the tensile test piece, and the true strain was measured in the longitudinal direction and the width direction within a nominal strain of 6 to 7% in the longitudinal direction to determine the r-value and the n-value.

TABLE 1

| Steel | Composition (mass %) | | | | | | | | | | | | |
|---|---|---|---|---|---|---|---|---|---|---|---|---|---|
| No. | C | Si | Mn | P | S | Al | N | Cr | Ti | Nb | Mo, Cu, Ni, B | Ca, REM* | Note |
| A | 0.08 | 0.03 | 1.8 | 0.01 | 0.0008 | 0.04 | 0.0020 | 0.03 | 0.14 | 0.05 | — | — | Example |
| B | 0.08 | 1.55 | 1.8 | 0.01 | 0.0008 | 0.04 | 0.0020 | 0.03 | 0.11 | 0.006 | — | — | Example |
| C | 0.08 | 1.50 | 1.8 | 0.01 | 0.0007 | 0.04 | 0.0020 | 0.03 | 0.10 | — | — | — | Example |
| D | 0.08 | 0.03 | 1.8 | 0.01 | 0.0008 | 0.04 | 0.0020 | 0.03 | 0.14 | 0.05 | Cu: 0.2, Ni: 0.2 | — | Example |
| E | 0.08 | 1.50 | 1.8 | 0.01 | 0.0008 | 0.04 | 0.0020 | 0.03 | 0.11 | 0.006 | B: 0.0010 | — | Example |
| F | 0.15 | 0.09 | 1.6 | 0.01 | 0.0030 | 0.04 | 0.0020 | 0.08 | 0.15 | 0.015 | Mo: 0.1 | Ca: 0.0030 | Example |
| G | 0.10 | 0.09 | 1.8 | 0.01 | 0.0008 | 0.04 | 0.0020 | 0.05 | 0.10 | 0.005 | Ni: 0.2 | — | Example |
| H | 0.35 | 0.03 | 1.8 | 0.01 | 0.0030 | 0.04 | 0.0020 | 0.03 | 0.15 | 0.005 | — | — | Comparative Example |
| I | 0.08 | 0.03 | 1.8 | 0.01 | 0.015 | 0.04 | 0.0020 | 0.03 | 0.14 | 0.005 | — | — | Comparative Example |
| J | 0.08 | 0.03 | 0.5 | 0.01 | 0.0030 | 0.04 | 0.0020 | 0.03 | 0.10 | 0.005 | — | — | Comparative Example |
| K | 0.03 | 0.03 | 1.8 | 0.01 | 0.0030 | 0.04 | 0.0020 | 0.03 | 0.14 | — | — | — | Comparative Example |
| L | 0.08 | 1.50 | 1.8 | 0.01 | 0.0008 | 0.15 | 0.0020 | 0.03 | 0.15 | — | — | — | Comparative Example |

*REM: Rare Earth Metal

TABLE 2

| | | Conditions for making Untreated Steel Pipe | | Conditions for producing Rolled Pipe | | | | |
|---|---|---|---|---|---|---|---|---|
| | | | | Heating (Soaking) | Diameter Reduction Rolling Conditions | | | |
| Pipe No. | Steel No. | Type of Steel Sheet | Temperature for Forming Open Pipe ° C. | Treatment Heating Temperature ° C. | Finish Rolling Temperature ° C. | Accumlated diameter Reduction Rate % | Accumulated diameter Reduction Rate below $Ar_3$ Transformation Point % | $Ar_3$ Transformation Point ° C. |
| 1 | A | Hot-rolled | R.T.* | 950 | 750 | 50 | 40 | 839 |
| 2 | B | Hot-rolled | R.T. | 950 | 780 | 55 | 40 | 895 |
| 3 | C | Hot-rolled | R.T. | 1000 | 750 | 60 | 30 | 888 |
| 4 | D | Hot-rolled | R.T. | 900 | 700 | 70 | 45 | 888 |
| 5 | E | Cold-rolled | R.T. | 950 | 730 | 80 | 60 | 830 |
| 6 | F | Hot-rolled | 500 | 900 | 650 | 65 | 45 | 818 |
| 7 | G | Cold-rolled | 500 | 900 | 650 | 40 | 35 | 799 |
| 8 | H | Hot-rolled | R.T. | 950 | 680 | 60 | 40 | 823 |
| 9 | I | Hot-rolled | R.T. | 950 | 700 | 60 | 40 | 862 |
| 10 | J | Hot-rolled | R.T. | 950 | 700 | 60 | 40 | 861 |
| 11 | K | Hot-rolled | R.T. | 950 | 720 | 60 | 40 | 952 |
| 12 | L | Cold-rolled | R.T. | 950 | 800 | 60 | 0 | 839 |
| 13 | A | Hot-rolled | R,T. | 950 | 680 | 30 | 10 | 839 |
| 14 | | Hot-rolled | R.T. | 950 | 650 | 30 | 20 | 839 |
| 15 | | Hot-rolled | R.T. | 950 | 400 | 50 | 30 | 839 |
| 16 | B | Hot-rolled | 500 | 950 | 950 | 50 | 0 | 895 |
| 17 | | Hot-rolled | 500 | 950 | 700 | 30 | 10 | 895 |
| 18 | | Hot-rolled | 500 | 950 | 700 | 30 | 20 | 895 |

*R.T.: Room Temperature

Each rolled steel pipe as a final product was cut into a length of 500 mm to use as a hydroforming test piece. As shown in FIG. 2, the cut pipe was loaded into the hydroforming apparatus, and water was supplied from an end of the pipe to burst the pipe by circular free bulging deformation. The maximum outer diameter at burst was measured to calculate the limiting bulging ratio LBR according to the following equation:

$$LBR(\%)=(d_{max}-d_0)/d_0\times 100$$

wherein $d_{max}$ is the maximum outer diameter (mm) of the pipe at burst (break) and $d_0$ is the outer diameter of the pipe before the test. Regarding the mold sizes shown in FIG. 1, $l_c$ was 127 mm, $d_c$ was 127 mm, $r_d$ was 5 mm, $l_0$ was 550 mm, and θ was 45° C.

The results are shown in Table 3.

TABLE 3

| | | Properties of Rolled Pipe | | | | | | | |
|---|---|---|---|---|---|---|---|---|---|
| | | Tensile Properities | | | | | | Free Bulging Test | |
| Pipe No. | Steel No. | Yield Strength (YS) MPa | Tensile Strength (TS) MPa | Elongation (El) % | n-value | r-value | n × r | Limiting Bulging Ratio LBR % | Note |
| 1 | A | 630 | 790 | 35 | 0.17 | 1.6 | 0.272 | 30 | Example |
| 2 | B | 642 | 800 | 34 | 0.18 | 1.7 | 0.306 | 28 | Example |
| 3 | C | 638 | 810 | 36 | 0.17 | 1.8 | 0.306 | 31 | Example |
| 4 | D | 645 | 800 | 35 | 0.16 | 1.8 | 0.288 | 27 | Example |
| 5 | E | 638 | 820 | 38 | 0.17 | 1.9 | 0.323 | 28 | Example |
| 6 | F | 705 | 860 | 32 | 0.18 | 1.8 | 0.324 | 32 | Example |
| 7 | G | 703 | 850 | 34 | 0.17 | 1.7 | 0.289 | 30 | Example |
| 8 | H | 850 | 1080 | 17 | 0.09 | 0.8 | 0.072 | 10 | Comparative Example |
| 9 | I | 645 | 800 | 35 | 0.12 | 1.0 | 0.120 | 12 | Comparative Example |
| 10 | J | 620 | 760 | 36 | 0.17 | 1.5 | 0.255 | 25 | Comparative Example |
| 11 | K | 420 | 520 | 45 | 0.18 | 1.8 | 0.324 | 30 | Comparative Example |
| 12 | L | 605 | 780 | 25 | 0.10 | 1.1 | 0.110 | 11 | Comparative Example |
| 13 | A | 635 | 790 | 34 | 0.11 | 1.2 | 0.132 | 13 | Comparative Example |
| 14 | | 620 | 800 | 33 | 0.11 | 1.0 | 0.110 | 10 | Comparative Example |
| 15 | | 815 | 860 | 15 | 0.09 | 1.0 | 0.09 | 12 | Comparative Example |
| 16 | B | 640 | 790 | 36 | 0.09 | 0.9 | 0.081 | 12 | Comparative Example |
| 17 | | 635 | 800 | 33 | 0.10 | 1.0 | 1.10 | 11 | Comparative Example |
| 18 | | 651 | 810 | 34 | 0.10 | 1.0 | 0.10 | 12 | Comparative Example |

The welded steel pipes according to the present invention each have a tensile strength of at least about 780 MPa, a high n-value, a high r-value, and a n×r product of at least about 0.22, showing excellent processability and hydroformability. In contrast, welded steel pipes according to Comparative Examples each have a low n×r product and a low LBR, showing poor hydroformability. Thus, the welded steel pipes according to Comparative Examples are unsuitable for components subjected to hydroforming.

Example 2

Each of steel sheets (hot-rolled steel sheets and cold-rolled annealed steel sheets) having compositions shown in Table 4 was rolled to form open pipes. The open pipes were but-jointed by induction heating to form a welded steel pipe having an outer diameter of 146 mm and a wall thickness of 2.5 mm. Each welded steel pipe as an untreated steel pipe was subjected to diameter reduction rolling under conditions shown in Table 5 to form a rolled steel pipe (final product).

Tensile test pieces (JIS No. 12A test pieces) in the longitudinal direction were prepared from the rolled steel pipe to measure the tensile properties (yield strength, tensile strength, and elongation), the n-value, and the r-value. The n-value and the r-value were determined as in Example 1.

Each rolled steel pipe as a final product was cut into a length of 500 mm to use as a hydroforming test piece. As shown in FIG. 2, the cut pipe was loaded into the hydroforming apparatus, and water was supplied from an end of the pipe to burst the pipe by circular free bulging deformation. The maximum outer diameter at burst was measured as in Example 1 to calculate the limiting bulging ratio LBR. The results are shown in Table 6.

TABLE 4

| Steel | Composition (mass %) | | | | | | | | | | | | |
|---|---|---|---|---|---|---|---|---|---|---|---|---|---|
| No. | C | Si | Mn | P | S | Al | N | Cr | Ti | Nb | Mo, Cu, Ni, B | Ca, REM* | Note |
| A1 | 0.09 | 0.19 | 3.0 | 0.02 | 0.0008 | 0.04 | 0.002 | 0.04 | 0.015 | 0.05 | — | — | Example |
| B1 | 0.13 | 0.19 | 3.0 | 0.02 | 0.0008 | 0.04 | 0.002 | 0.01 | 0.015 | 0.02 | — | — | Example |
| C1 | 0.16 | 1.0 | 2.7 | 0.02 | 0.0008 | 0.04 | 0.005 | 0.10 | 0.006 | 0.002 | — | — | Example |
| D1 | 0.09 | 0.19 | 3.0 | 0.02 | 0.0008 | 0.04 | 0.003 | 0.04 | 0.015 | 0.05 | Cu: 0.2, Ni: 0.2 | — | Example |
| E1 | 0.13 | 0.19 | 3.0 | 0.02 | 0.0008 | 0.04 | 0.002 | 0.01 | 0.015 | 0.02 | B: 0.0010 | — | Example |
| F1 | 0.16 | 1.0 | 3.0 | 0.02 | 0.0008 | 0.04 | 0.005 | 0.10 | 0.006 | 0.002 | Mo: 0.1 | Ca: 0.0030 | Example |
| G1 | 0.09 | 0.19 | 3.0 | 0.02 | 0.0020 | 0.04 | 0.002 | 0.04 | 0.015 | 0.05 | — | REM: 0.0030 | Example |
| H1 | 0.35 | 0.19 | 3.0 | 0.02 | 0.0008 | 0.04 | 0.002 | 0.04 | 0.015 | 0.05 | — | — | Comparative Example |
| I1 | 0.09 | 0.19 | 1.5 | 0.02 | 0.0030 | 0.04 | 0.002 | 0.04 | 0.015 | 0.05 | — | — | Comparative Example |
| J1 | 0.16 | 0.19 | 3.0 | 0.02 | 0.015 | 0.04 | 0.002 | 0.04 | 0.015 | 0.02 | — | — | Comparative Example |
| K1 | 0.03 | 0.19 | 3.0 | 0.02 | 0.0030 | 0.04 | 0.002 | 0.04 | 0.015 | 0.02 | — | — | Comparative Example |
| L1 | 0.13 | 0.19 | 3.0 | 0.02 | 0.0008 | 0.15 | 0.002 | 0.01 | 0.015 | 0.02 | — | — | Comparative Example |

*REM: Rare Earth Metal

TABLE 5

| | | | | Conditions for producing Rolled Pipe | | | | |
|---|---|---|---|---|---|---|---|---|
| | | Conditions for making Untreated Steel Pipe | | Heating (Soaking) | Diameter Reduction Rolling Conditions | | | |
| Pipe No. | Steel No. | Type of Steel Sheet | Temperature for Forming Open Pipe ° C. | Treatment Heating Temperature ° C. | Finish Rolling Temperature ° C. | Accumlated diameter Reduction Rate % | Accumulated diameter Reduction Rate below $Ar_3$ Transformation Point % | $Ar_3$ Transformation Point ° C. |
| 2-1 | A1 | Hot-rolled | R.T.* | 950 | 650 | 60 | 30 | 763 |
| 2-2 | B1 | Hot-rolled | R.T. | 950 | 650 | 60 | 25 | 751 |
| 2-3 | C1 | Hot-rolled | R.T. | 1000 | 700 | 50 | 30 | 784 |
| 2-4 | D1 | Hot-rolled | R.T. | 900 | 650 | 70 | 35 | 756 |
| 2-5 | E1 | Cold-rolled | R.T. | 950 | 650 | 80 | 25 | 751 |
| 2-6 | F1 | Hot-rolled | 500 | 900 | 700 | 60 | 30 | 787 |
| 2-7 | G1 | Cold-rolled | R.T. | 900 | 680 | 50 | 35 | 762 |
| 2-8 | H1 | Hot-rolled | R.T. | 950 | 660 | 60 | 35 | 766 |
| 2-9 | I1 | Hot-rolled | R.T. | 950 | 720 | 50 | 40 | 808 |
| 2-10 | J1 | Hot-rolled | R.T. | 950 | 710 | 60 | 35 | 785 |
| 2-11 | K1 | Hot-rolled | R.T. | 950 | 710 | 60 | 40 | 789 |
| 2-12 | L1 | Cold-rolled | R.T. | 950 | 650 | 65 | 35 | 751 |
| 2-13 | A1 | Hot-rolled | R.T. | 950 | 680 | 30 | 10 | 765 |
| 2-14 | | Hot-rolled | R.T. | 950 | 700 | 30 | 20 | 765 |
| 2-15 | | Hot-rolled | R.T. | 950 | 400 | 50 | 30 | 765 |
| 2-16 | B1 | Hot-rolled | 500 | 950 | 950 | 50 | 0 | 751 |
| 2-17 | | Hot-rolled | 500 | 950 | 700 | 30 | 10 | 751 |
| 2-18 | | Hot-rolled | 500 | 950 | 700 | 30 | 20 | 751 |

*R.T.: Room Temperature

TABLE 6

| | | Properties of Rolled Pipe | | | | | | | |
|---|---|---|---|---|---|---|---|---|---|
| | | Tensile Properities | | | | | | Free Bulging Test | |
| Pipe No. | Steel No. | Yield Strength (YS) MPa | Tensile Strength (TS) MPa | Elongation (El) % | n-value | r-value | n × r | Limiting Bulging Ratio LBR % | Note |
| 2-1 | A1 | 810 | 1050 | 25 | 0.13 | 1.3 | 0.169 | 20 | Example |
| 2-2 | B1 | 830 | 1030 | 24 | 0.14 | 1.4 | 0.196 | 18 | Example |
| 2-3 | C1 | 700 | 1060 | 24 | 0.15 | 1.4 | 0.210 | 17 | Example |
| 2-4 | D1 | 670 | 1080 | 24 | 0.14 | 1.3 | 0.182 | 18 | Example |
| 2-5 | E1 | 834 | 1180 | 25 | 0.13 | 1.3 | 0.169 | 19 | Example |
| 2-6 | F1 | 865 | 1230 | 24 | 0.14 | 1.4 | 0.196 | 20 | Example |
| 2-7 | G1 | 820 | 1040 | 25 | 0.14 | 1.4 | 0.196 | 21 | Example |
| 2-8 | H1 | 960 | 1200 | 23 | 0.14 | 1.0 | 0.110 | 15 | Comparative Example |
| 2-9 | I1 | 620 | 750 | 32 | 0.13 | 1.4 | 0.182 | 18 | Comparative Example |
| 2-10 | J1 | 810 | 990 | 36 | 0.10 | 1.2 | 0.100 | 9 | Comparative Example |
| 2-11 | K1 | 536 | 670 | 40 | 0.11 | 1.3 | 0.143 | 15 | Comparative Example |
| 2-12 | L1 | 850 | 1050 | 24 | 0.09 | 1.2 | 0.108 | 8 | Comparative Example |
| 2-13 | A1 | 860 | 1030 | 25 | 0.09 | 0.05 | 0.0855 | 7 | Comparative Example |
| 2-14 | | 850 | 1040 | 25 | 0.09 | 0.85 | 0.0765 | 6 | Comparative Example |
| 2-15 | | 1090 | 1200 | 10 | 0.08 | 0.85 | 0.068 | 6 | Comparative Example |
| 2-16 | B1 | 780 | 980 | 25 | 0.09 | 0.90 | 0.081 | 7 | Comparative Example |
| 2-17 | | 820 | 1030 | 24 | 0.08 | 0.85 | 0.068 | 6 | Comparative Example |
| 2-18 | | 830 | 1020 | 25 | 0.08 | 0.90 | 0.072 | 7 | Comparative Example |

The welded steel pipes according to the present invention each have a tensile strength of at least 980 MPa, a high n-value, a high r-value, and a n×r product of at least 0.15, showing enhanced processability and hydroformability. In contrast, welded steel pipes according to Comparative Examples each have a low n×r product and a low LBR, showing poor hydroformability. Thus, the welded steel pipes according to Comparative Examples are unsuitable for components subjected to hydroforming.

What is claimed is:

1. A welded steel pipe having excellent hydroformability having a composition comprising, on the basis of mass percent:

about 0.05% to about 0.3% C;

about 0.01% to about 2.0% Si;

more than about 1.5% to about 5.0% Mn:

about 0.01% to about 0.1% P;

about 0.01% or less of S;

about 0.01% to about 0.1% Cr;

about 0.01% to about 0.1% Al;

about 0.01% to about 0.1% Nb:

about 0.01% to about 0.3% Ti:

about 0.001% to about 0.01% N; and the balance being Fe and incidental impurities, wherein the welded steel pipe has a tensile strength of 780 MPa or more, and the n×r product of the n-value and the r-value is about 0.15 or more.

2. The welded steel pipe according to claim 1, wherein the composition comprises, on the basis of mass percent:

about 0.05% to about 0.3% C;

about 0.01% to about 2.0% Si;

more than about 1.5% to about 2.0% Mn; about 0.01% to about 0.1% P;

about 0.01% or less of S;

about 0.01% to about 0.1% Cr;

about 0.01% to about 0.1% Al;

about 0.01% to about 0.1% Nb;

about 0.1% to about 0.3% Ti;

about 0.001% to about 0.01% N; and the balance being Fe and incidental impurities, wherein the welded steel pipe has a tensile strength of in the range of about 780 MPa to about 980 MPa, and the n×r product of the n-value and the r-value is about 0.22 or more.

3. The welded steel pipe according to claim 2, wherein the n-value is about 0.15 or more or the r-value is about 1.5 or more.

4. The welded steel pipe according to either claim 2 or 3, further comprising at least one element group selected from the group consisting of Group A and Group B, on the basis of mass percent, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth metal.

5. The welded steel pipe according to claim 1, wherein the composition comprises, on the basis of mass percent:

about 0.05% to about 0.3% C;

about 0.01% to about 2.0% Si;

more than about 2.0% to about 5.0% Mn;

about 0.01% to about 0.1% P;

about 0.01% or less of S;

about 0.01% to about 0.1% Cr:

about 0.01% to about 0.1% Al;

about 0.01% to about 0.1% Nb;

about 0.01% to about 0.1% or less of Ti;

about 0.001% to about 0.01% N; and the balance being Fe and incidental impurities, wherein the welded steel pipe has a tensile strength of more than about 980 MPa, and the n×r product of the n-value and the r-value is about 0.15 or more.

6. The welded steel pipe according to claim 5, wherein the n-value is about 0.10 or more or the r-value is about 1.0 or more.

7. The welded steel pipe according to either claim 5 or 6, further comprising at least one element selected from the group consisting of Group A and Group B, on the basis of mass percent, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth metal.

8. A method for producing a welded steel pipe having excellent hydroformability comprising:

heating or soaking an untreated welded steel pipe having a steel composition containing, on the basis of mass percent: about 0.05% to about 0.3% C, about 2.0% or less of Si, more than about 1.5% to about 5.0% Mn, about 0.1% or less of P, about 0.01% or less of S, about 0.1% or less of Cr, about 0.1% or less of Al, about 0.1% or less of Nb, about 0.3% or less of Ti, and about 0.01% or less of N; and diameter reduction-rolling the treated steel pipe at an accumulated diameter reduction rate of about 35% or more and a finish rolling temperature of about 500° C. to about 900° C., such that the welded steel pipe has a tensile strength of 780 MPa or more and a n×r product of an n-value and an r-value of about 0.15 or more.

9. The method for producing a welded steel pipe according to claim 8, wherein the treated steel pipe is diameter-reduction-rolled at a accumulated diameter reduction rate of about 20% or more at a temperature below the $Ar_3$ temperature point.

10. The method for producing a welded steel pipe according to either claim 8, or 9, wherein the composition comprises, or the basis of mass percent, about 0.05% C to about 0.3% C; about 2.0% or less of Si; more than about 1.5% to about 2.0% Mn; about 0.1% or less of P; about 0.01% or less of S; about 0.1% or less of Cr; about 0.1% or less of Al; about 0.1% or less of Nb; about 0.1% to about 0.3% Ti; and about 0.01% or less of N, wherein the tensile strength of the welded steel pipe has a tensile strength of in the range of about 780 MPa to about 980 MPa, and the n×r product of the n-value and the r-value is about 0.22 or more.

11. The method for producing a welded steel pipe according to claim 10, further comprising at least one element group selected from the group consisting of Group A and Group B, on the basis of mass percent, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth metal.

12. The method for producing a welded steel pipe according to either claim 8 or 9, wherein the composition comprises, on the basis of mass percent, about 0.05% to about 0.3% C; about 2.0% or less of Si; more than about 2.0% to about 5.0% Mn; about 0.1% or less of P; about 0.01% or less of S; about 0.1% or less of Cr; about 0.1% or less of Al; about 0.1% or less of Nb; about 0.1% or less of Ti; and about 0.01% or less of N, wherein the tensile strength of the welded steel pipe has a tensile strength of more than about 980 MPa, and the n×r product of the n-value and the r-value is about 0.15 or more.

13. A method for producing a welded steel pipe according to claim 12, further comprising at least one element group selected from the group consisting of Group A and Group B, on the basis of mass percent, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth metal.

* * * * *

UNITED STATES PATENT AND TRADEMARK OFFICE

CERTIFICATE OF CORRECTION

PATENT NO. : 6,682,829 B2
DATED : January 27, 2004
INVENTOR(S) : Takaaki Toyooka et al.

It is certified that error appears in the above-identified patent and that said Letters Patent is hereby corrected as shown below:

Column 10,
Table 1, under Steel No. H, under subheading C, change "0.35" to -- 0.35 --; under Steel No. I, under subheading S, change "0.015" to -- 0.015 --; under Steel No. J, under subheading Mn, change "0.5" to -- 0.5 --; under Steel No. K, under subheading C, change "0.03" to -- 0.03 --; and under Steel No. L, under subheading A1, change "0.15" to -- 0.15 --.

Column 12,
Table 2, under Pipe No. 13, under subheading Temperature for Forming Open Pipe, change "R,T." to -- R.T. --
Table 3, under Pipe No. 17, under subheading n x r, change "1.10" to -- 0.10 --

Signed and Sealed this

Thirteenth Day of July, 2004

JON W. DUDAS
*Acting Director of the United States Patent and Trademark Office*